US005816602A

United States Patent [19]

Hayashi

[11] Patent Number: 5,816,602

[45] Date of Patent: Oct. 6, 1998

[54] STOPPER FOR SNOW BOARD

[75] Inventor: Toshiaki Hayashi, Sanjo, Japan

[73] Assignee: S.I.N.C. Corporation, Sanjo, Japan

[21] Appl. No.: 969,464

[22] Filed: Nov. 13, 1997

[30] Foreign Application Priority Data

May 16, 1997 [JP] Japan ..... 9-126974

[51] Int. Cl.[6] ..... A63C 7/10

[52] U.S. Cl. ..... 280/604; 280/605; 280/14.2

[58] Field of Search ..... 280/604, 605, 280/14.2; 188/5

[56] References Cited

U.S. PATENT DOCUMENTS

| | | | |
|---|---|---|---|
| 4,985,561 | 1/1991 | Humphre | 280/605 |
| 5,156,644 | 10/1992 | Koehler | 280/605 |
| 5,356,168 | 10/1994 | Ozburn | 280/605 |

*Primary Examiner*—Richard M. Camby
*Attorney, Agent, or Firm*—Kanesaka & Takeuchi

[57] ABSTRACT

A stopper for a snow board operates to stop sliding of the snow board when a boot is removed from a binding, and to allow sliding of the snow board when the boot is mounted on the binding. The stopper is formed of a stopping device including a base member attached to the snow board or binding, a cylindrical member attached to the base member, and a rod slidably situated in the cylindrical member; a spring attached to the base member for urging the rod in the cylindrical member downwardly; and an operating device having an operating portion linked to the rod for operating the rod in the cylindrical member. When the operation portion is moved to a lower position by an outer force, e.g. boot, the rod is moved to a retracted position, and when the operating portion is in an upper position by the spring, the rod is held in a projecting position to allow the rod to operate as a stopper.

8 Claims, 6 Drawing Sheets

STOPPER FOR SNOW BOARD

BACKGROUND OF THE INVENTION AND RELATED ART STATEMENT

The present invention relates to a stopper for a snow board for stopping the snow board not to slide along an accumulated snow surface when a boot is not mounted on a binding of the snow board.

Conventionally, as a stopper for stopping a snow board, a band, called leash which is wound around a leg, has been used.

However, winding or unwinding of the leash to or from the leg has to be carried out in addition to attachment or detachment of a boot to or from a binding of the snow board, which has been very troublesome.

Accordingly, it is an object of the present invention to provide a stopper for a snow board, wherein a complicated work, such as winding a leash around a leg, is not required.

Another object of the invention is to provide a stopper for a snow board as stated above, wherein when a boot is removed from a binding, the stopper functions, and in a state where the boot is mounted on the binding, the stopper function is released, as in a stopper of skis.

Still further object of the invention is to provide a stopper for a snow board as stated above, which has a durable strength superior to that of a stopper for skis.

Further objects and advantages of the invention will be apparent from the following description of the invention.

SUMMARY OF THE INVENTION

According to the invention, a stopper for a snow board includes a stopping device and an operating device. The stopping device is formed of a pair of cylindrical member or pipes and a pair of rods or piston rods to be vertically movable relative to the cylindrical pipes. The stopping device A is disposed on a base member which is attached to a snow board or a binding fixed to the board. The base member is fixed to the board or the binding such that the lower ends of the piston rods of the stopping device call be moved to a position lower than the board.

The operating device for vertically operating the piston rods of the stopping device is also provided on the base member. The operating device includes an operating portion so that the piston rods of the stopping device are vertically operated by a vertical movement of the operating portion. The operation device has an elastic member, such as a spring, for urging the operating portion to move upward when a boot is not mounted to the binding. When the base member is fixed to the board or binding, the operating portion is located at a position to be stepped by a boot mounted on the binding.

In case the boot is mounted on the binding, when the operating portion is stepped downward against an urging force of the spring, the lower ends of the piston rods of the stopping device are retreated to a position higher than the board. When the boot is removed from the binding and the operating portion is moved upward, the lower ends of the piston rods of the stopping device project to a position lower than the board.

According to the invention, a linking device may be used as the operating device.

The linking device for vertically operating the piston rods of the stopping device is fixed to the base member. The linking device includes the operating portion so that the piston rods of the stopping device are vertically operated by a vertical movement of the operating portion. The linking device has an elastic member, such as a spring, for urging the operating portion to move upward when the boot is not mounted to the binding. When the operating portion is operated, the linking device actuates to move the piston rods as explained already.

Further, according to the invention, a gear device may be used as the operating device.

The gear device for vertically operating the piston rods of the stopping device is also provided to the base member. The gear device includes the operating portion so that the piston rods of the stopping device are vertically operated by a vertical movement of the operating portion. The gear device has an elastic member, such as a spring, for urging the operating portion to move upward when the boot is not mounted to the binding. When the operating portion is operated, the gear device actuates to move the piston rods as explained already.

Advantages and operations of the preferable embodiments of the invention are briefly explained.

In a state where the boot is not mounted on the binding, the spring urges the operating portion to move upward, i.e. the operating portion is located to the uppermost position. Thus, the piston rods of the stopping device are moved downward relative to cylindrical pipes through the operating device, so that the lower ends of the piston rods project to a position lower than the snow board and are inserted into snow. Therefore, the snow board is held not to slide on a snow surface.

On the other hand, in case the operating portion is stepped down against the urging force of the spring when the boot is mounted on the binding, the piston rods of the stopping device are moved upward relative to the cylindrical pipes through the operating device, so that the lower ends of the piston rods are retreated to a position higher than the board to thereby allow the snow board to slide on the snow surface.

In the present invention, the stopping device is actuated by one step operation in cooperation with attachment or detachment of the boot to or from the binding. Therefore, the complicated winding or unwinding of a leash is not required in addition to the attachment or detachment of the boot to or from the binding, as in the prior art. Thus, the stopper for the snow board of the present invention is superior in a practical use.

Further, since the stopping device has a dumping structure formed of the cylindrical pipes and the piston rods movable up and down relative to the cylindrical pipes, the stopper of the present invention has higher durable strength and accuracy in operation when compared with those of the conventional stoppers for skis.

DETAILED DESCRIPTION OF A PREFERRED EMBODIMENT

Embodiments of the present invention are explained referring to the attached drawings.

Figure 1:
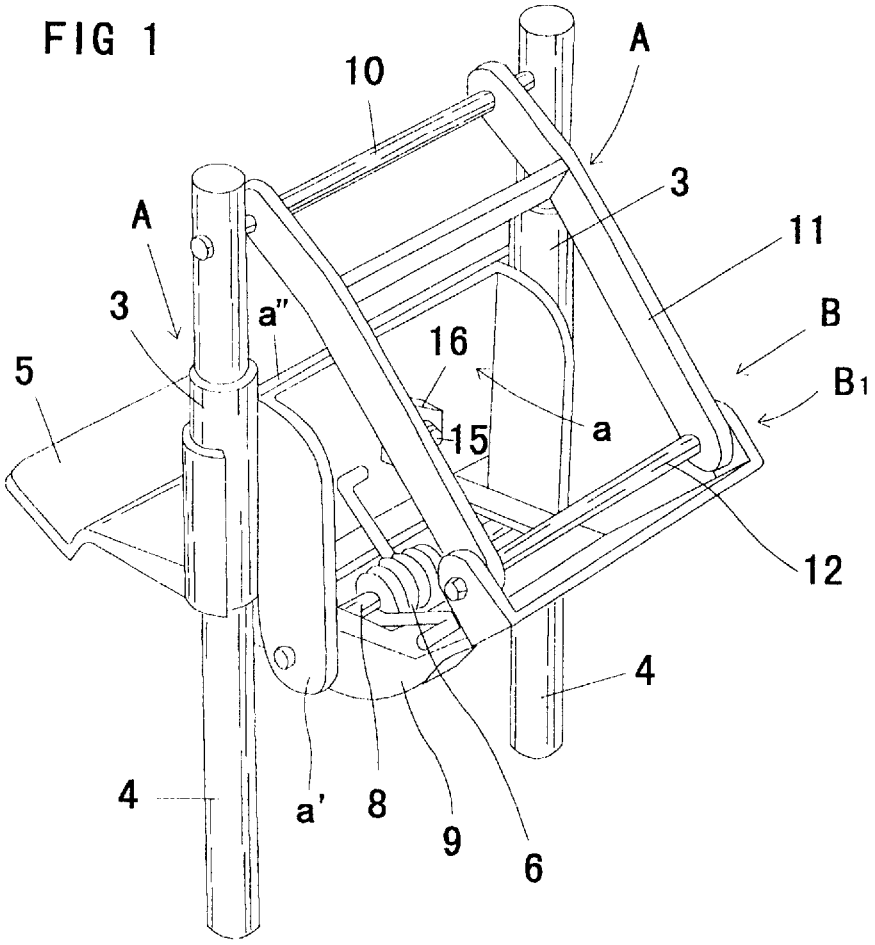
FIG. 1 is a perspective view of a first embodiment of a stopper according to the present invention.
Figure 2:
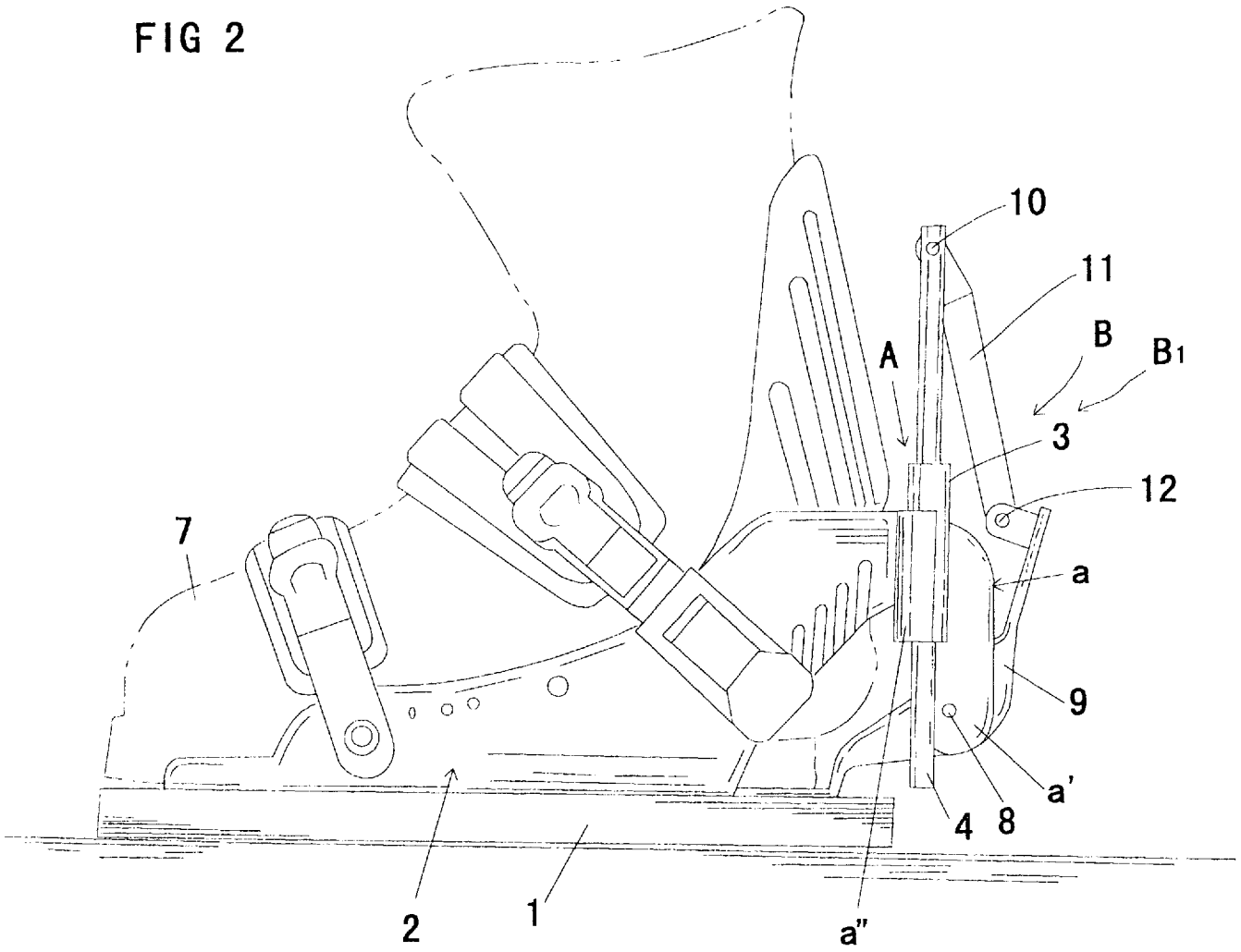
FIG. 2 is a side view for showing a state where a boot is mounted on a binding in the first embodiment.
Figure 3:
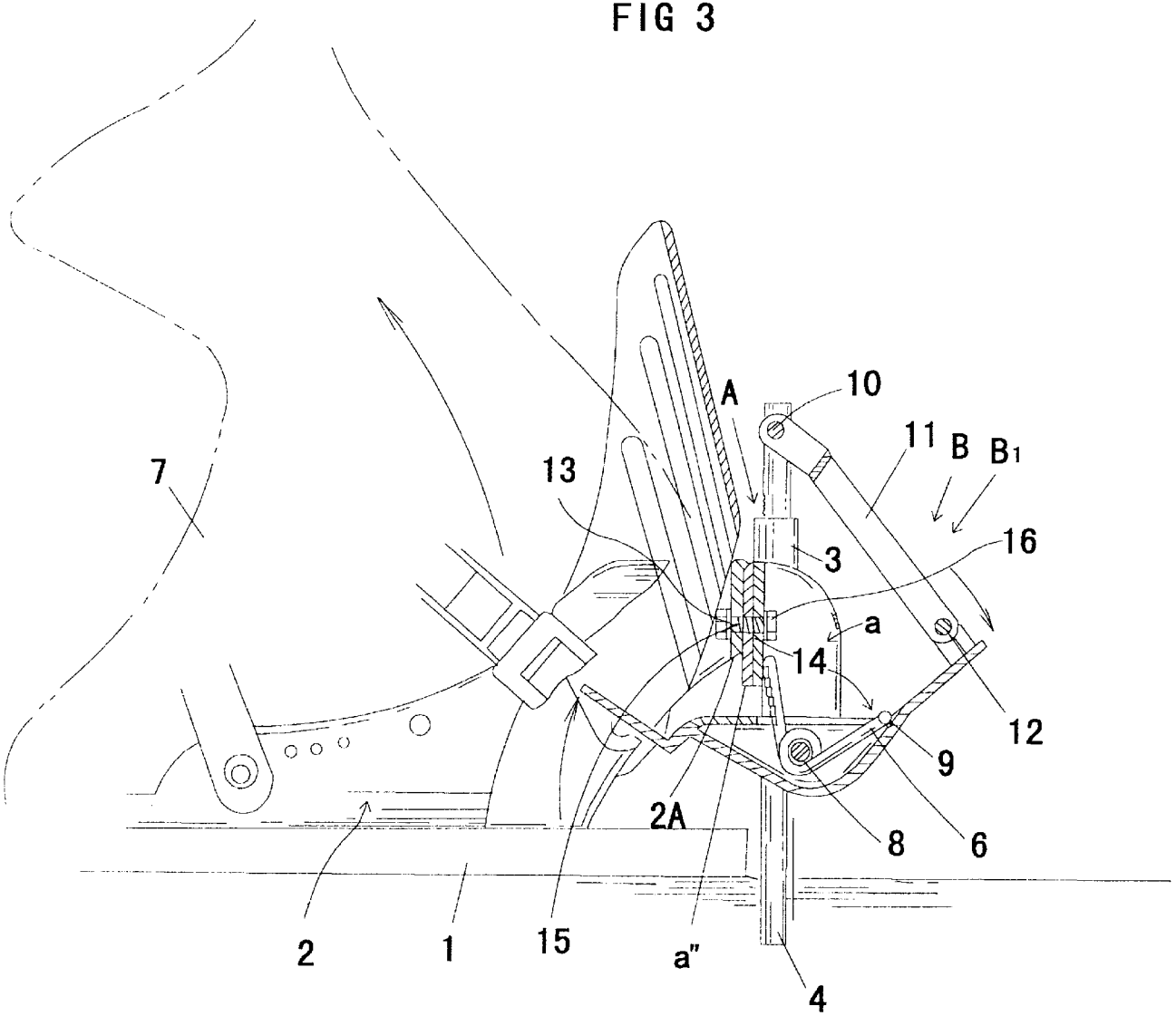
FIG. 3 is a side view for showing a state where the boot is removed from the binding in the first embodiment.

FIGS. 1–3 show a first embodiment of the present invention. A base member a is attached to a binding 2 which is, in turn, fixed to a snow board 1. The base member a is provided with a stopping device A formed of a pair of cylindrical pipes 3 and piston rods 4.

The base member a is formed of a flat plate by folding both ends thereof forward to have a U-shape in a plane view. Also, lower parts of both folded ends of the base member a are extended downward to form extended portions a'.

The stopping device A is provided with a supplemental plate a" laminated to the base member a at a left side thereof as shown in FIG. 1 and having a width in a transverse direction greater than that of the base member a, so that both ends of the supplemental plate a" vertically hold the respective cylindrical pipes 3, into which the piston rods 4 are slidably supported, respectively.

A length of the piston rods 4 is determined according to a height with which the base member a is attached to the binding 2. More specifically, in case the base member a is attached to a specific position, i.e. high position, on a back side of the binding 2, the piston rods 4 are required to have a length such that lower ends of the piston rods 4 can move downward from a high position above the board 1 to a position lower than the board 1. In case the base member a is attached to a low position on the back side of the binding 2, the length of the piston rods 4 can be shorter.

Also, a through hole 14 for attaching the base member a to the binding 2 is provided at an approximate center of the base member a to pass through the base member a and the supplemental plate a".

Now, a structure for attaching the base member a to the binding 2 is explained. As shown in FIG. 3, a hole 13 is formed at a middle portion of a heel wall 2A of the binding 2, and the heel wall 2A abuts against the supplemental plate a" of the base member a so that the hole 13 aligns the through hole 14. A bolt 15 is inserted into the holes 13, 14, and a forward end thereof is tightened by a nut 16 to thereby fix the base member a to the binding 2. As described above, the hole 13 is formed on the heel wall 2A of the binding 2 to thereby tighten and fix the base member a and the supplemental plate a" to the binding 2 by the bolt 15 and the nut 16. Thus, the stopping device of the invention can be easily fixed to the existing binding 2.

Also, the base member a is provided with an operating device B for vertically operating the piston rods 4 of the stopping device A. The operating device B includes an operating portion 5 so that the piston rods 4 of the stopping device A are vertically actuated by the vertical movement of the operating portion 5.

The operating device B employs, as a first embodiment, a linking device B1 comprising a linking mechanism.

Specifically, the linking device B1 is formed of a first linking member 9 in an arch shape to swing at a middle portion thereof around a bearing or supporting pin 8 installed between the extended portions a' of the base member a. The first linking member 9 is swung forward and backward around the bearing pin 8 as a supporting point.

On the one hand, upper ends of the piston rods 4 extend upward through the cylindrical pipes 3, and one end of a second linking member 11 is disposed around a bearing pin 10 installed between the upper ends of the piston rods 4, so that the second linking member 11 swings around the bearing pin 10 as a supporting point.

Then, the other end of the second linking member 11 is pivotally mounted to an attaching pin 12 provided to a forward end of the first linking member 9. When a rear end of the first linking member 9 swings downward, i.e. operating portion 5 is pushed down, the piston rods 4 are elevated relative to the cylindrical pipes 3 by a linking operation of the first linking member 9 and the second linking member 11. When the rear end of the first linking member 9, i.e. operating portion 5, swings upward, the piston rods 4 are moved downward relative to the cylindrical pipes 3 by the similar linking operation.

Also, the rear end of the first linking member 9 is formed to be inclined upward to constitute the operating portion 5.

Further, an elastic member, such as a torsion spring, 6 is provided at a position where the first linking member 9 is pivotally mounted, so that the operating portion 5 is urged not to move upward, in other words, the operating portion 5 is located at the uppermost position. More specifically, in a normal state, the piston rods 4 of the stopping device A project downward through the cylindrical pipes 3 beyond the board 1. When the operating portion 5 is moved or pushed downward against the urging force of the torsion spring 6, the respective piston rods 4 are moved upward relative to the cylindrical pipes 3, so that the portions of the piston rods 4 projected downward through the cylindrical pipes 3 become short. Namely, the lower ends of the piston rods 4 are located above the board 1.

Next, an operation of the stopping device A of the first embodiment is explained.

In a state where a boot 7 is not mounted on the binding 2, the piston rods 4 are urged downward by the torsion spring 6 through the linking device B1, so that the lower ends of the piston rods 4 project to a side lower than the board 1 to be stuck into the accumulated snow and work as a stopper. Also, in cooperation with the lowering movement of the piston rods 4, the operating portion 5 is moved upward through the linking device B1.

In case the boot 7 is mounted to the binding 2, when the elevated operating portion 5 is stepped downward against the urging force of the spring 6, the piston rods 4 are moved upward relative to the cylindrical pipes 3 through the linking device B1, and the lower ends of the piston rods 4 are retreated to a side higher than the board 1 to thereby permit sliding of the board 1.

Figure 4:
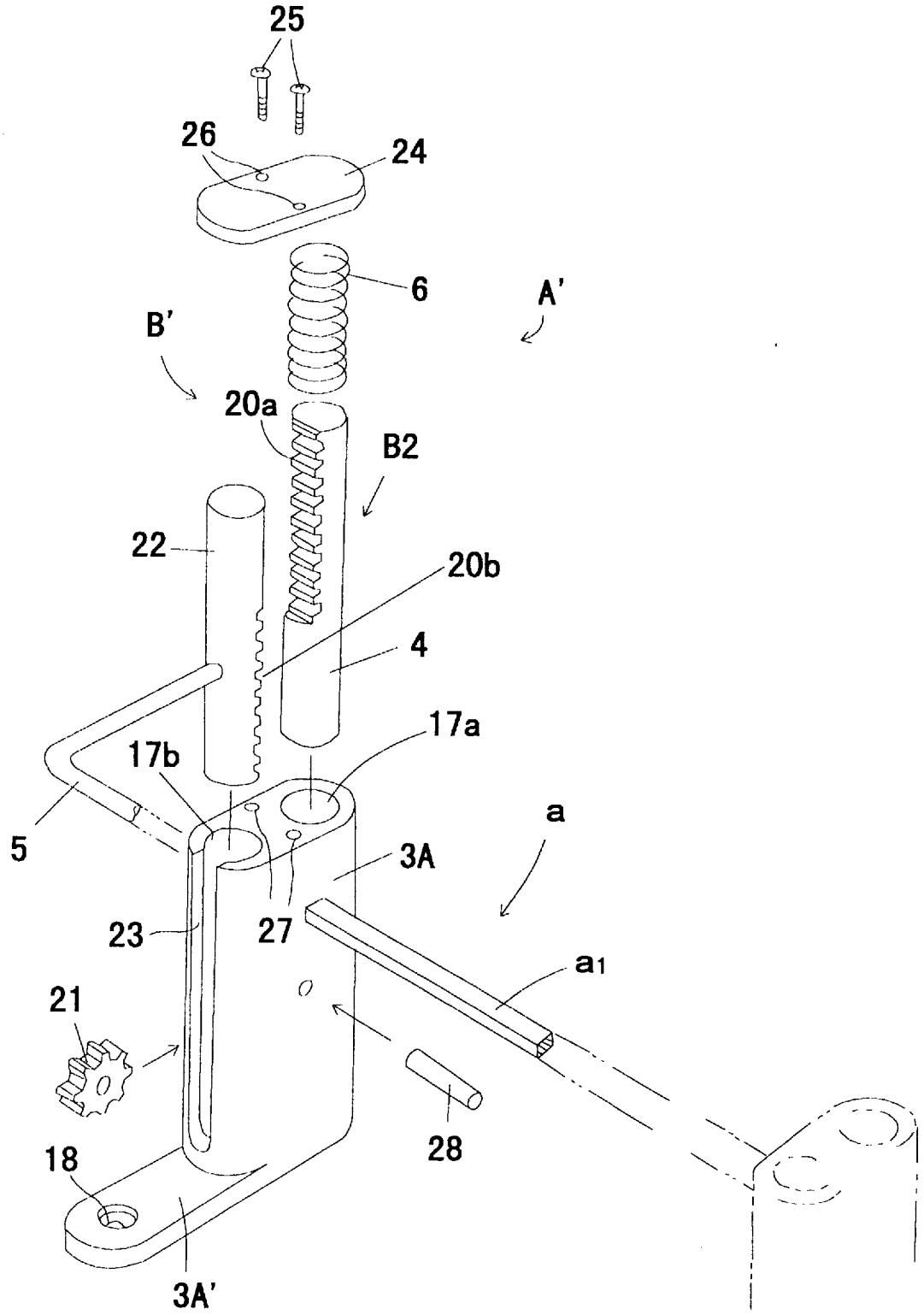
FIG. 4 is a partly cut exploded perspective view for explaining a structure of a stopper in a second embodiment.
Figure 5:
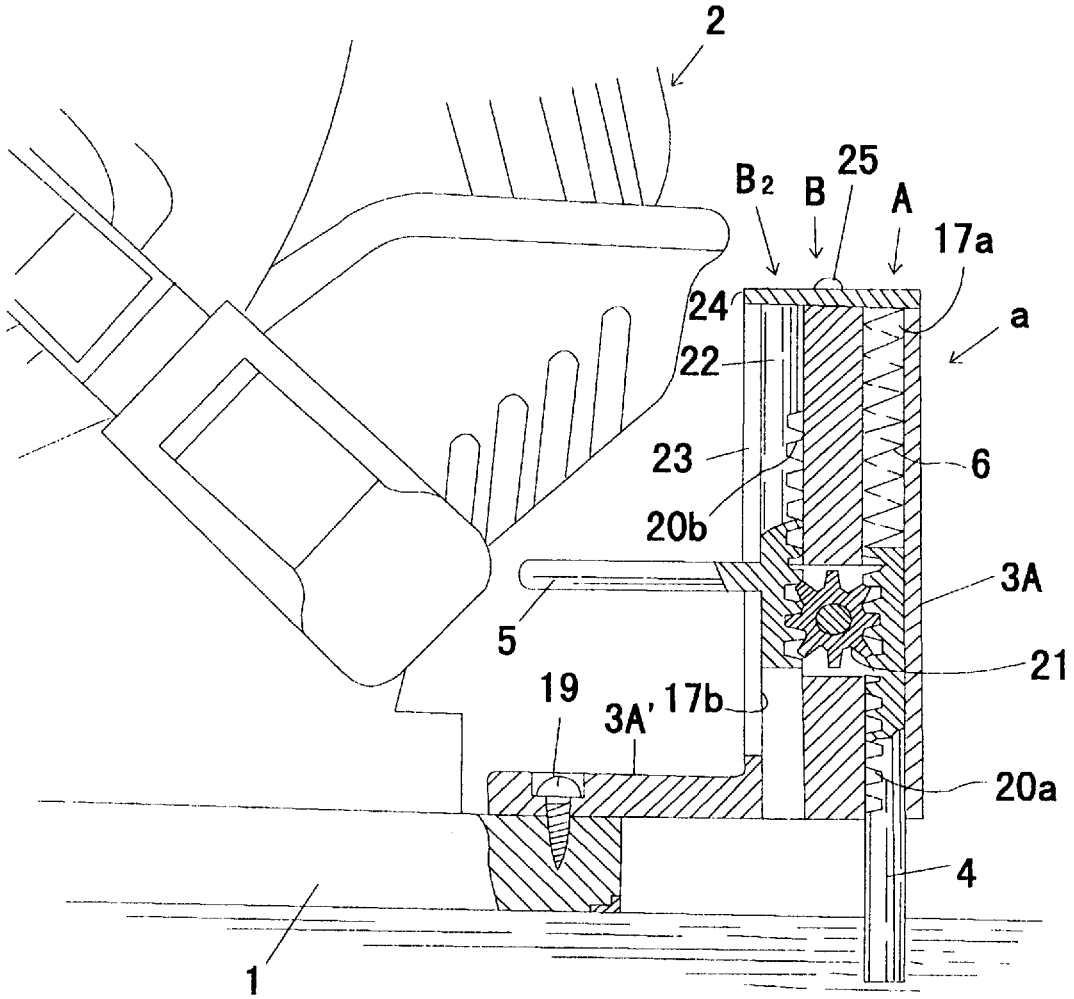
FIG. 5 is a partly cut side view for showing a state where a boot is mounted on a binding in the second embodiment.

FIGS. 4 and 5 show a second embodiment of the present invention.

A base member a of the second embodiment is formed of a pair of facing cylindrical pipes 3A with a predetermined distance therebetween, and a supporting pin a1 installed between the facing cylindrical pipes 3A and integrally fixed thereto.

Also, each cylindrical pipe 3A has a thickness in a transverse direction in the drawing, and vertical through holes 17*a*, 17*b* are formed therein side by side. Each cylindrical pipe 3A is provided with a vertical cutout window 23 at a left or front side thereof, and the left-side through hole 17*b* is communicated with an outside of the cylindrical pipe 3A through the cutout window 23.

Further, each cylindrical pipe 3A for constituting the base member a is provided with a projecting portion 3A' projected to the left side, in the drawing, from a lower portion of the cylindrical pipe 3A, and each projecting portion 3A' has a screw hole 18. A bottom part of each cylindrical pipe 3A abuts against the board 1 and is fixed thereto by a screw 19 through the screw hole 18, so that the base member a is fixed to the board 1.

The stopping device A' of the second embodiment is formed of a pair of piston rods 4 slidably inserted into the through holes 17*a* provided on the right side of the respective cylindrical pipes 3A in the drawing.

An operating device B' for actuating the stopping device A' of the second embodiment is formed of a gear mechanism B2 including racks 20*a*, 20*b* and a pinion 21.

Specifically, the rack 20*a* is formed in a predetermined vertical area of a circumferential surface of each piston rod 4.

On the one hand, a supplemental rod 22 is provided with the rack 20*b* in a predetermined vertical area of a circumferential surface thereof, and inserted into the through hole 17*b* of the cylindrical pipe 3A. The rack 20*b* of each supplemental rod 22 faces the rack 20*a* of each piston rod 4 in the inner sides thereof, and the pinion 21 is supported by a shaft 28 to be rotatable between the facing racks 20*a* and 20*b* to thereby engage with each other.

Therefore, the piston rod 4 is moved reversely relative to the vertical movement of the supplemental rod 22 according to a relationship of the racks 20*a*, 20*b* and the pinion 21.

Further, a stepping bar as the operating portion 5 is formed to extend between the respective supplemental rods 22 in a shape of U-character, and both ends thereof are fixed on the circumferential surfaces opposite to the racks 20*b* of the respective supplemental rods 22, so that the stepping bar 5 projects to an outside of the cylindrical pipes 3A through the cutout windows 23.

Therefore, when the stepping bar 5 is moved downward, the piston rod 4 is moved upward in cooperation therewith, while when the stepping bar 5 is moved upward, the piston rod 4 is moved downward.

An elastic member, such as a coil spring, 6 is inserted into the through hole 17*a* above the piston rod 4, as shown in the drawing, and then a cover 24 for closing an upper part of the cylindrical pipe 3A is fixed thereon. A reference numeral 25 represents screws for fixing the cover 24; 26 represents holes for inserting the screws 25 thereinto and formed on the cover 24; and 27 represents screw holes for fixing the screws 25 thereinto.

Next, an operation of the stopping device A' of the second embodiment is described.

In a state where a boot 7 is not mounted on the binding 2, the piston rods 4 are urged downward by the coil springs 6, so that the lower ends of the piston rods 4 project to a side lower than the board 1 to penetrate into accumulated snow and operate as a stopper. The supplemental rods 22 are moved upward through the gear mechanisms B2 in cooperation with the downward movement of the piston rods 4, so that the operation portion 5 is located in an elevated state.

When the boot 7 is mounted onto the binding 2, the operating portion 5 held in the elevated state is stepped down against an urging force by the spring 6, and the piston rods 4 are moved upward relative to the supplemental rods 22 through the gear mechanisms B2, so that the lower ends of the piston rods 4 are retreated to a side higher than the board 1.

Figure 6:
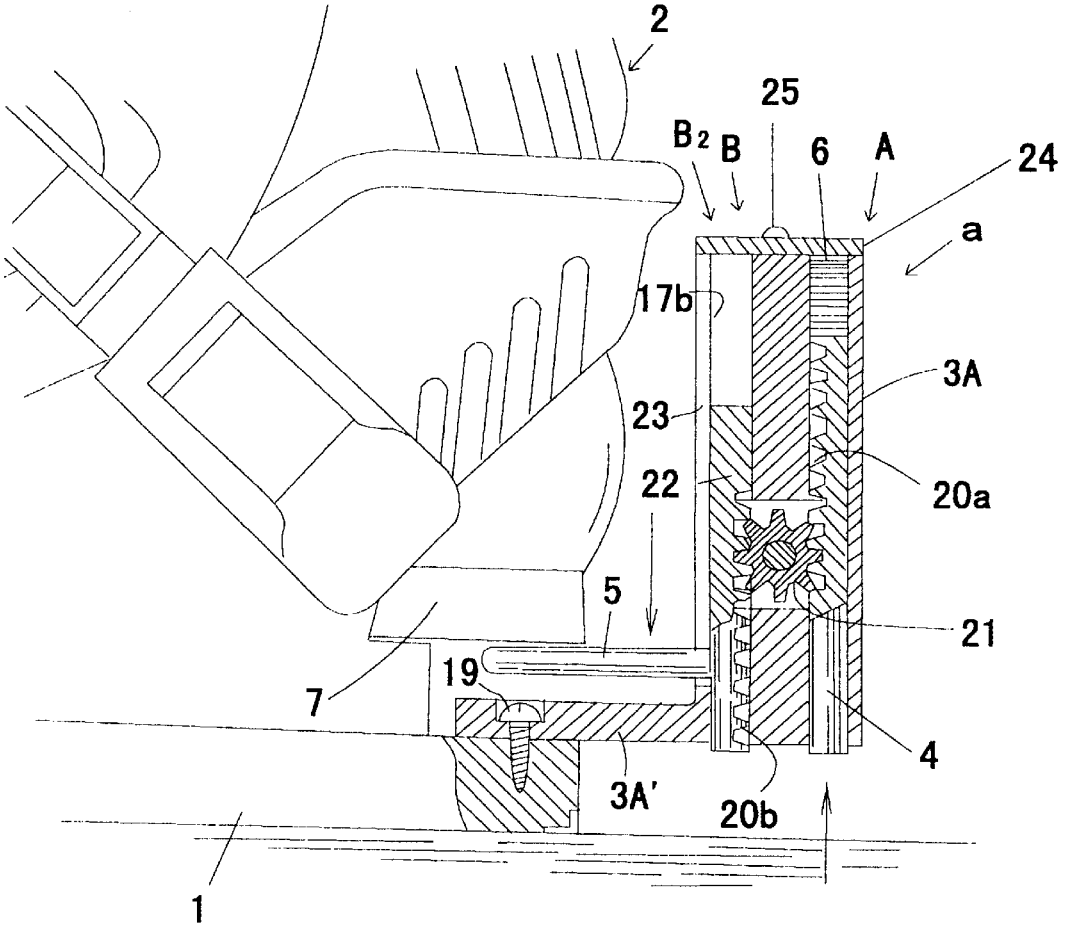
FIG. 6 is a partly cut side view for showing a state where the boot is removed from the binding in another example of the second embodiment of the invention.

FIG. 6 shows another example of the second embodiment of the invention. A spiral groove may be formed around an outer periphery of each piston rod 4' instead of the rack 20*a* in the second embodiment, and the piston rod 4 may be moved up and down while being rotated by the pinion 21.

According to the first aspect of the invention, since the stopping device is actuated by one stepping operation in cooperation with attachment or detachment of the boot to or from the binding, the stopping device of the invention does not require the complicated winding or unwinding of the leash in addition to the attachment or detachment of the boot to or from the binding, as in the conventional art. Thus, the present invention provides a practical stopper for a snow board. Also, since the stopper for the snow board is formed of the pair of cylindrical pipes and the piston rods vertically moving relative to the respective cylindrical pipes, the stopper has a high durable strength and operates accurately.

Also, according to the first aspect of the present invention, in addition to the above-stated advantages, since the operation device for operating the stopping device is formed of the linking mechanism, the stopping device can be easily manufactured due to the simple structure at a low cost thereby to facilitate a mass production thereof.

According to the second aspect of the present invention, in addition to the advantages of the first aspect of the invention, since the operation device for operating the stopping device is formed of the gear mechanism, the stopper for the snow board can be easily manufactured due to the simple structure at a low cost to thereby facilitate a mass production thereof.

What is claimed is:

1. A stopper for a snow board comprising:

a stopping device including a base member adapted to be immovably fixed relative to a snow board, a cylindrical member attached to the base member, and a rod slidably situated in the cylindrical member;

a spring attached to the base member for urging the rod in the cylindrical member downwardly; and an operating device having an operating portion linked to the rod for operating the rod in the cylindrical member so that when the operation portion is moved to a lower position by an outer force, said rod is moved to a retracted position, and when the operating portion is in an upper position by the spring, the rod is held in a projecting position to allow the rod to operate as a stopper.

2. A stopper for a snow board according to claim 1, wherein said stopping device includes two cylindrical members spaced apart from each other, and two rods, each rod being slidably situated in each cylindrical member and linked to the operating device so that when the operating portion is actuated, the two rods operate simultaneously.

3. A stopper for a snow board according to claim 1, wherein said operating device is a linking mechanism including a first linking member swingably connected to the base member and having said operating portion at one end, and a second linking member connected between the other end of the first linking member and an upper portion of the rod.

4. A stopper for a snow board according to claim 3, wherein said spring is situated between the base member and the first linking member.

5. A stopper for a snow board according to claim 1, wherein said operating device is a gear mechanism including a supplemental bar with a first rack, and a pinion rotationally held in the base member and engaging the first rack, said rod having a second rack engaging the pinion, said operating device being connected to the supplemental bar to move the same.

6. A stopper for a snow board according to claim 5, wherein said base member is a housing having therein the cylindrical member for the rod, a supplemental hole situated adjacent to the cylindrical member for slidably receiving the supplemental bar therein, and a slit for allowing the operating device to pass therethrough to be connected to the supplemental bar.

7. A stopper for a snow board according to claim 6, wherein said spring is a coil spring situated above the rod in the housing.

8. A stopper for a snow board according to claim 5, wherein said second rack is a part of a spiral groove formed around the rod.

* * * * *